US010894995B2

(12) United States Patent
Hamada et al.

(10) Patent No.: US 10,894,995 B2
(45) Date of Patent: Jan. 19, 2021

(54) AUSTENITIC STAINLESS STEEL SHEET FOR EXHAUST COMPONENT HAVING EXCELLENT HEAT RESISTANCE AND WORKABILITY, TURBOCHARGER COMPONENT, AND METHOD FOR PRODUCING AUSTENITIC STAINLESS STEEL SHEET FOR EXHAUST COMPONENT

(71) Applicant: NIPPON STEEL & SUMIKIN STAINLESS STEEL CORPORATION, Tokyo (JP)

(72) Inventors: Junichi Hamada, Tokyo (JP); Chikako Takushima, Tokyo (JP); Atsuhisa Yakawa, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 207 days.

(21) Appl. No.: 16/087,337

(22) PCT Filed: Mar. 23, 2017

(86) PCT No.: PCT/JP2017/011872
§ 371 (c)(1),
(2) Date: Sep. 21, 2018

(87) PCT Pub. No.: WO2017/164344
PCT Pub. Date: Sep. 28, 2017

(65) Prior Publication Data

US 2020/0131595 A1 Apr. 30, 2020

(30) Foreign Application Priority Data

Mar. 23, 2016 (JP) ..... 2016-059073

(51) Int. Cl.
*C21D 9/46* (2006.01)
*C22C 38/06* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 38/58; C21D 8/005; C21D 6/004
See application file for complete search history.

(56) References Cited

U.S. PATENT DOCUMENTS

2005/0194073 A1 9/2005 Hamano et al.
2010/0068040 A1 3/2010 Nakamura
(Continued)

FOREIGN PATENT DOCUMENTS

JP 9-279315 A 10/1997
JP 2005-15896 A 1/2005
(Continued)

OTHER PUBLICATIONS

International Preliminary Report on Patentability and Written Opinion of the International Searching Authority (Forms PCT/IB/326, PCT/IB/373, and PCT/ISA/237) for International Application No. PCT/JP2017/011872, dated Oct. 4, 2018, with English Translation.
(Continued)

*Primary Examiner* — Scott R Kastler
(74) *Attorney, Agent, or Firm* — Birch, Stewart, Kolasch & Birch, LLP

(57) ABSTRACT

The present invention particularly has as its technical problem to provide austenitic stainless steel sheet used as the material for housings of turbochargers in which excellent heat resistance and workability are demanded. The auste-
(Continued)

nitic stainless steel sheet according to the present invention comprises, by mass %, C: 0.005 to 0.2%, Si: 0.1 to 4%, Mn: 0.1 to 10%, Ni: 2 to 25%, Cr: 15 to 30%, N: 0.01 to less than 0.4%, Al: 0.001 to 1%, Cu: 0.05 to 4%, Mo: 0.02 to 3%, V: 0.02 to 1%, P: 0.05% or less, and S: 0.01% or less, comprises a balance of Fe and unavoidable impurities, and has an annealing twin frequency of 40% or more and is excellent in heat resistance.

21 Claims, 1 Drawing Sheet

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***F02B 39/00*** | (2006.01) |
| ***F04C 29/04*** | (2006.01) |
| *F01N 3/28* | (2006.01) |

(52) U.S. Cl.

CPC ..... *C21D 8/0205* (2013.01); *C21D 8/0236* (2013.01); *C22C 38/001* (2013.01); *C22C 38/002* (2013.01); *C22C 38/005* (2013.01); *C22C 38/008* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *F02B 39/00* (2013.01); *F04C 29/04* (2013.01); *C21D 2211/001* (2013.01); *F01N 3/2803* (2013.01)

(56) References Cited

U.S. PATENT DOCUMENTS

| | | | | |
|---|---|---|---|---|
| 2011/0041964 | A1* | 2/2011 | Schuh ..... | C21D 7/13 148/559 |
| 2013/0336834 | A1 | 12/2013 | Matsuhashi et al. | |
| 2015/0083283 | A1 | 3/2015 | Inoue et al. | |
| 2015/0329947 | A1* | 11/2015 | Ferraiuolo ..... | C22C 38/44 148/610 |
| 2016/0032434 | A1 | 2/2016 | Inoue et al. | |

FOREIGN PATENT DOCUMENTS

| | | | |
|---|---|---|---|
| JP | 2005-281855 | A | 10/2005 |
| JP | 2006-16669 | A | 1/2006 |
| JP | 2008-63602 | A | 3/2008 |
| JP | 2011-168819 | A | 9/2011 |
| JP | 4937277 | B2 | 5/2012 |
| JP | 2012-207259 | A | 10/2012 |
| JP | 2013-209730 | A | 10/2013 |
| WO | WO 2014/157655 | A1 | 10/2014 |

OTHER PUBLICATIONS

International Search Report (form PCT/ISA/210) for International Application No. PCT/JP2017/011872, dated Jun. 13, 2017, with English Translation.

* cited by examiner

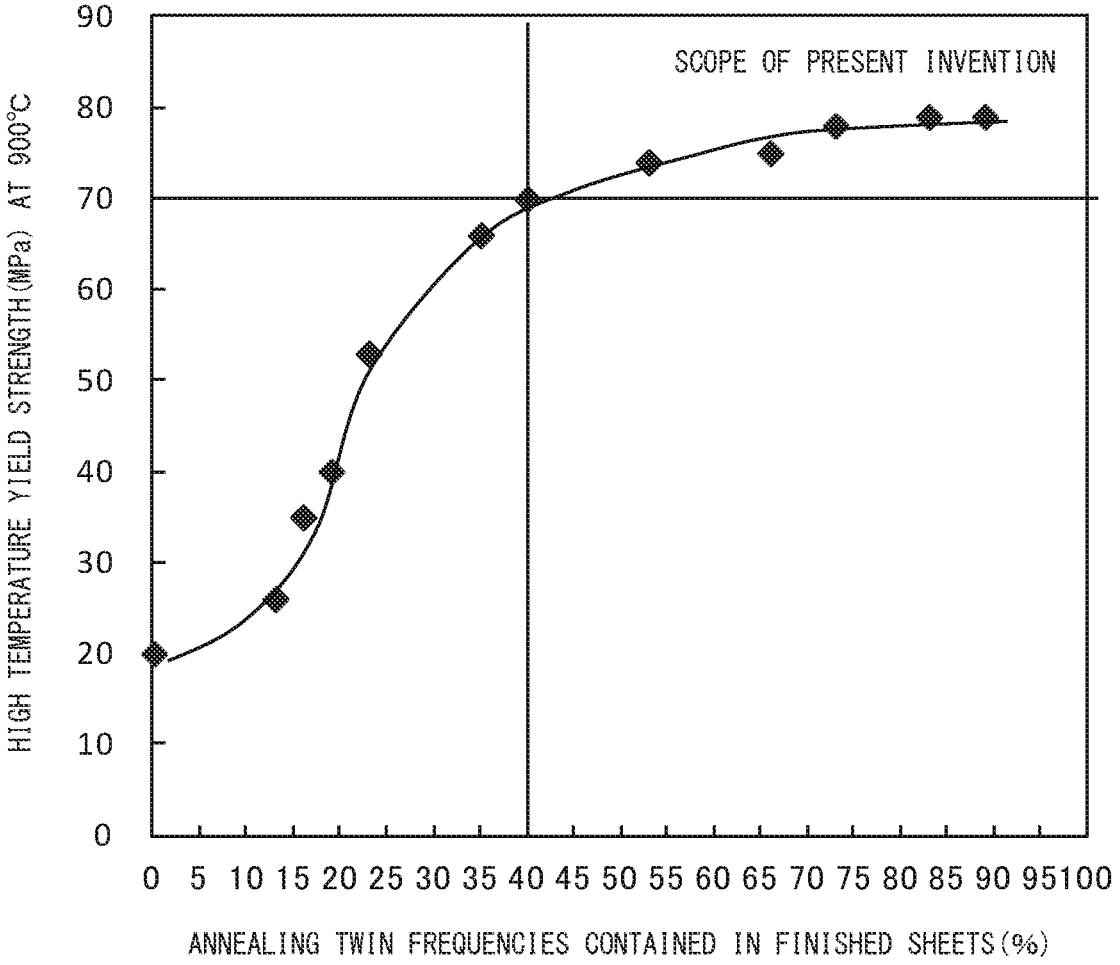
SCOPE OF PRESENT INVENTION
HIGH TEMPERATURE YIELD STRENGTH(MPa) AT 900°C
0
10
20
30
40
50
60
70
80
90
0 5 10 15 20 25 30 35 40 45 50 55 60 65 70 75 80 85 90 95100
ANNEALING TWIN FREQUENCIES CONTAINED IN FINISHED SHEETS(%)

AUSTENITIC STAINLESS STEEL SHEET FOR EXHAUST COMPONENT HAVING EXCELLENT HEAT RESISTANCE AND WORKABILITY, TURBOCHARGER COMPONENT, AND METHOD FOR PRODUCING AUSTENITIC STAINLESS STEEL SHEET FOR EXHAUST COMPONENT

FIELD

The present invention relates to austenitic stainless steel sheet used as the material for a heat resistant component in which heat resistance and workability are demanded. In particular, it is applied to exhaust holds, converters, and turbocharger components of automobiles. Further, among these as well, it more particularly relates to a material optimum for nozzle mounts, nozzle plates, vanes, back plates, and other internal precision components and for housings of turbochargers mounted in gasoline cars and diesel cars.

BACKGROUND

Exhaust manifolds, front pipes, center pipes, mufflers, and environmental system components for purification of exhaust gas which automobiles are equipped with are made with materials having excellent oxidation resistance, high temperature strength, thermal fatigue characteristics, and other heat resistance so that high temperature exhaust gas can be stably passed therethrough. Further, the environment is a corrosive one due to condensed water, so excellent corrosion resistance is also demanded.

From the viewpoints of toughening of exhaust gas controls, improvement of engine performance, lightening of vehicle bodies, etc., stainless steel is made much use of for these components. Further, in recent years, exhaust gas controls have been further toughened. In addition, fuel efficiency has been improved and sizes have been reduced. Due to these and other trends, in particular, the temperatures of the exhaust gas running through the exhaust manifolds right under the engines have been rising as a general trend. In addition, cases where supercharging devices like turbochargers are mounted have increased. Greater improvement of heat resistance is therefore required from stainless steel used for exhaust manifolds and turbochargers. Regarding the rise in exhaust gas temperatures, exhaust gas temperatures used to be about 900° C., but are expected to rise to up to 1000° C. or so.

On the other hand, turbochargers are complicated in internal structures. Raising the supercharging efficiency and securing reliability against heat are important. Use of heat resistant austenitic stainless steel is therefore mainly disclosed. In addition to the representative heat resistant austenitic stainless steel SUS310S (25% Cr-20% Ni) and Ni-based alloys etc., PTL 1 discloses steel containing high amounts of Cr and Mo. Further, an exhaust guide component of a nozzle vane type turbocharger using austenitic stainless steel in which Si: 2 to 4% is added is disclosed in PTL 2.

In PTL 2, the steel constituents are defined in consideration of the hot workability at the time of steelmaking, but the high temperature characteristics sought from the components cannot be said to be sufficiently satisfied. Further, maintaining the hole expandability of punched out holes is considered important, but with steel constituents defined from the hot workability, sufficient hole expandability could not be obtained. Furthermore, cast stainless steel is used for the housings of turbochargers, but this is thick, so there is a need for reduction of thickness and weight.

PTL 3 discloses to set optimal ranges of contents of Nb, V, C, N, Al, and Ti and optimize the production process so as to improve the high temperature strength and creep characteristic of heat resistant austenitic stainless steel sheet. However, the technical problem of the invention disclosed in PTL 3 is the improvement of high temperature strength and creep characteristic at 800° C. The invention disclosed in PTL 3 is insufficient for dealing with exhaust gas over 900° C.

Further, PTL 4 discloses optimizing the material composition and treatment conditions so as to obtain heat resistant austenitic stainless steel with a hardness of 40 HRC or more at room temperature after heat treatment at 700° C. for 400 hours. However, the technical problem of the invention disclosed in PTL 4 is to obtain a high temperature strength able to withstand a 550° C. or more usage environment. PTL 4 just shows high temperature strength at 700° C. The heat resistant austenitic stainless steel according to the invention disclosed in PTL 4 is insufficient for dealing with exhaust gas over 900° C.

Further, PTL 5 states that improvement of the intergranular corrosion resistance and improvement of the high temperature strength is realized using a small grain size material wherein the low ΣCSL grain boundary frequency and crystal average particle size etc. are controlled. However, the "high temperature strength" in PTL 5 is high temperature strength in water. PLT 5 does not disclose any specific solution for achieving strength against exhaust gas over 900° C.

Further, the stainless steel for nuclear power plant use disclosed in PTL 6 increases the twin boundary ratio in steel so as to secure excellent intergranular corrosion resistance in high temperature water. However, PTL 6 does not disclose high temperature strength of stainless steel for nuclear power plant use. Further, PTL 6 does not disclose any specific solution for achieving strength against exhaust gas over 900° C.

Further, the corrosion resistant austenitic alloy disclosed in PTL 7 is characterized by cold working an austenitic alloy by over 30% and heat treating it to form twin boundaries inside the austenite crystal grains and form precipitates dispersed at the austenite grain boundaries and/or on the twin boundaries. By virtue of this characteristic, intergranular slip is suppressed and intergranular strength is raised, so the corrosion resistant austenitic alloy has a higher stress corrosion crack progression resistance. However, the stress corrosion crack progression resistance shown in PTL 7 is a characteristic in high temperature water. PTL 7 does not disclose any specific solution for achieving strength against exhaust gas over 900° C.

CITATION LIST

Patent Literature

[PTL 1] WO2014/157655

[PTL 2] Japanese Patent No. 4937277

[PTL 3] Japanese Unexamined Patent Publication No. 2013-209730

[PTL 4] Japanese Unexamined Patent Publication No. 2005-281855

[PTL 5] Japanese Unexamined Patent Publication No. 2011-168819

[PTL 6] Japanese Unexamined Patent Publication No. 2005-15896

[PTL 7] Japanese Unexamined Patent Publication No. 2008-63602

SUMMARY

Technical Problem

When conventional thin-gauge stainless steel sheet is exposed to the high temperature environment described in the background art, deformation occurs due to the insufficient high temperature strength and rigidity and the problems of contact with components inside the turbochargers and poor flow of the exhaust gas arise. In addition, there are also the problems of fatigue failure caused by vibration and thermal fatigue failure due to the thermal cycle. In conventional austenitic stainless steel sheet, if adding alloy elements for improving the high temperature strength, the ductility at room temperature becomes insufficient and complicated shaped housings cannot be formed. The technical problem which the present invention is intended to solve is to solve the above-mentioned problems and provide austenitic stainless steel sheet suitable specifically for components of turbochargers among automobile exhaust components and suitable specifically for housings which require heat resistance and workability.

The components which fall within the technical problem to be solved by the present application include all of the components comprising a turbocharger. Specifically, the housing forming the outer shell of a turbocharger, the precision components inside of a variable nozzle vane-type turbocharger (for example, what are referred to as the back plate, oil deflector, compressor wheel, nozzle mount, nozzle plate, nozzle vane, drive ring, and drive lever) are covered. In particular, the present invention covers components suitable for housings, which require not only high temperature strength specifically but also formability as an important property.

Solution to Problem

To solve the above problem, the inventors engaged in detailed studies on the relationships among the metal structures and high temperature characteristics of austenitic stainless steel sheet and the room temperature workability. As a result, they discovered that for example for materials in which heat resistance is demanded among components like turbochargers which are exposed to extremely harsh heat environments, by using the steel constituents to secure the heat resistance and controlling the properties of the crystal grain boundaries in the metal structure, characteristics remarkably excellent in high temperature strength are obtained. Further, satisfactory workability cannot be obtained by only controlling the steel constituents in a similar manner such as described in PTL 2. The inventors succeeded in achieving the workability together with high temperature strength by the above-mentioned control of the properties of the crystal grain boundaries.

The gist of the present invention for solving the above problem lies in:

(1) Austenitic stainless steel sheet for an exhaust component having excellent heat resistance comprising, by mass %, C: 0.005 to 0.2%, Si: 0.1 to 4%, Mn: 0.1 to 10%, Ni: 2 to 25%, Cr: 15 to 30%, N: 0.01 to less than 0.4%, Al: 0.001 to 1%, Cu: 0.05 to 4%, Mo: 0.02 to 3%, V: 0.02 to 1%, P: 0.05% or less, and S: 0.01% or less, comprising a balance of Fe and unavoidable impurities, and having an annealing twin frequency of 40% or more.

(2) The austenitic stainless steel sheet for an exhaust component having excellent heat resistance and workability according to (1) wherein the steel sheet further comprises, by mass %, N: over 0.04% to less than 0.4% and/or Si: over 1.0% to less than 3.5%.

(3) The austenitic stainless steel sheet for an exhaust component having excellent heat resistance and workability according to (1) or (2) wherein the steel sheet further comprises, by mass %, N: over 0.15% to less than 0.4%.

(4) The austenitic stainless steel sheet for an exhaust component having excellent heat resistance and workability according to any one of (1) to (3) wherein the steel sheet further comprises, by mass %, one or more of Ti: 0.005 to 0.3%, Nb: 0.005 to 0.3%, B: 0.0002 to 0.005%, Ca: 0.0005 to 0.01%, W: 0.1 to 3.0%, Zr: 0.05 to 0.30%, Sn: 0.01 to 0.50%, Co: 0.03 to 0.30%, Mg: 0.0002 to 0.010%, Sb: 0.005 to 0.3%, REM: 0.002 to 0.2%, Ga: 0.0002 to 0.3%, and Ta: 0.01 to 1.0%.

(5) The austenitic stainless steel sheet for an exhaust component having excellent heat resistance and workability according to any one of (1) to (4) wherein the steel sheet further comprises, by mass %, Ti: over 0.03% to 0.3% and/or Nb: 0.005 to 0.05%.

(6) The austenitic stainless steel sheet for an exhaust component having excellent heat resistance and workability according to any one of (1) to (5) wherein the steel sheet has a high temperature yield strength at 900° C. of 70 Mp or more.

(7) A method for producing austenitic stainless steel sheet for an exhaust component having excellent heat resistance and workability according to any one of (1) to (6), the method for producing stainless steel sheet comprising steps of cold rolling and annealing the cold rolled sheet, wherein in the step of cold rolling, a reduction is in a range of 60% or less and wherein in the step of annealing the cold rolled sheet, a heating rate at a temperature which is less than 900° C. is less than 10° C./sec, a heating rate at a temperature of 900° C. and more is 10° C./sec or more, and a highest temperature is in a range of from 1000 to 1200° C.

(8) The austenitic stainless steel sheet according to any one of (1) to (6), wherein the austenitic stainless steel sheet is used for at least one of a housing forming an outer shell of a turbocharger and a precision component at the inside of a nozzle vane type turbocharger.

(9) The austenitic stainless steel sheet according to any one of (1) to (6), wherein the austenitic stainless steel sheet is used for at least one of a back plate, oil deflector, compressor wheel, nozzle mount, nozzle plate, nozzle vane, drive ring, and drive lever inside of a nozzle vane type turbocharger.

(10) An exhaust component fabricated using stainless steel sheet according to any one of (1) to (6).

(11) An exhaust component wherein at least one of a housing forming an outer shell of a turbocharger and a precision part inside of a nozzle vane type turbocharger is fabricated using austenitic stainless steel sheet according to any one of (1) to (6).

(12) A housing forming an outer shell of a turbocharger fabricated using austenitic stainless steel sheet according to any one of (1) to (6).

(13) A nozzle vane type turbocharger wherein at least one of a back plate, oil deflector, compressor wheel, nozzle mount, nozzle plate, nozzle vane, drive ring, and drive lever is fabricated using austenitic stainless steel sheet according to any one of (1) to (6).

Advantageous Effects of Invention

The present invention provides austenitic stainless steel sheet having both excellent formability at room temperature and high temperature characteristics. The application of the present invention to exhaust components of automobiles (in particular, housings of turbochargers) contributes to reducing weight and improving resistance to higher exhaust temperatures of the exhaust components.

BRIEF DESCRIPTION OF DRAWINGS

FIG. 1 is a view showing the relationship of the annealing twin frequency in stainless steel sheet and the high temperature yield strength at 900° C.

DESCRIPTION OF EMBODIMENTS

Below, the reasons for limitation of the present invention will be explained. The important property of austenitic stainless steel sheet used for heat resistant applications is the high temperature strength. However, particularly, considering application to the above housings of turbochargers, workability is also extremely important. As explained above, housings of turbochargers are complicated in shape. Further, if the housings excessively deform in a high temperature environment, the housings will result in components contacting each other or impediment to the flow of gas etc., thereby inviting breakage or a drop in heat efficiency and leading to a fall in reliability of the performance of the components. Therefore, to secure such reliability, the inventors earnestly engaged in microscopic studies on the crystal grain boundary structures of austenitic stainless steel and obtained the following findings.

First of all, the point of the annealing twin frequency at the crystal grain boundaries being made 40% or more will be explained. It is known that in austenitic stainless steel, annealing twins are formed after cold rolling and annealing. "Annealing twins" are crystal twins formed when the metal structure recrystallizes due to the cold rolling step and annealing step. The adjoining crystal grains of the annealing twins have relative misorientations. At the grain boundaries between the crystal grains (below, simply referred to as "the twin boundaries"), there is a relative misorientation of approximately 60° (60°±within 8°) about the <111> axis. Annealing twins are related to the stacking fault energy. A material with a small stacking fault energy has a large number of crystal twins. However, it had not been made clear what kind of effect such twin boundaries had on the high temperature deformation, strength, etc.

A twin boundary is observed as a twin boundary at a cross-section of a material. In view of this feature, the inventors investigated the relationship between the annealing twin frequency and high temperature strength. Here, the "annealing twin frequency" is the ratio of the lengths of twin boundaries of annealing twins to the total length of the crystal grain boundaries present in the observed range of a cross-section of the material. To calculate the annealing twin frequency, EBSP (Electron Back-Scattering Diffraction Pattern) is used to analyze the crystal orientations for a region of about 300 μm thickness×about 100 μm width in an area of ¼ or so thickness from the center of thickness of the material. The total length of the crystal grain boundaries present in the observed range was measured and the relative misorientation between the crystal grain boundaries was measured. Next, the ratio of twin lengths of the crystal twins having interfaces of a relative misorientation of 60°±8° about the <111> axis to the total length of the crystal grain boundaries was calculated.

Further, a high temperature tensile test was performed by preparing a tensile test piece so that the rolling direction and tensile direction became parallel. A constant speed tensile test was performed at a heating rate of 100° C./min, a holding time of 10 min, and a crosshead speed of 1 mm/min to obtain a 0.2% yield strength in the rolling direction. The high temperature strengths when testing austenitic stainless steel sheets having various annealing twin frequencies at 900° C. by high temperature tensile tests are shown in FIG. 1.

In view of the results of FIG. 1, it is learned that sheets with higher annealing twin frequencies had higher high temperature strengths at 900° C. and that if the annealing twin frequency is 40% or more, high strength materials of 70 MPa or more are obtained. Further, the temperature of the material of the housing of the turbocharger is estimated to be 900° C. or so in a gasoline powered vehicle. From that structure, 70 MPa or more in terms of the 0.2% yield strength of the present test method is necessary.

In the present invention, it was discovered that a rise in the annealing twin frequency causes a rise in the high temperature strength. The reason is believed to be the low intergranular energy of twin boundaries. That is, twin boundaries are lower in intergranular energy than the intergranular boundaries with multiorientation relationship together, and therefore the interface migrations in a high temperature environment becomes slower. The inventors studied the migration of ordinary grain boundaries at a high temperature and twin boundaries in a high temperature environment. As a result, they discovered that ordinary grain boundaries are fast in migration and result in easier coarsening of the crystal grains while twin boundaries are slow in migration and therefore twin boundaries are left out from the process of crystal grain coarsening and exhibit a unique structural form in a high temperature environment. As a result, they discovered that in a material with a large number of twin boundaries, due to the twin boundaries left behind from the process of coarsening of the crystal grains, a kind of strengthening resembling strengthening due to crystal grain refinement is manifested at a high temperature.

Further, in heat resistant austenitic stainless steel, various precipitates (r phase, Cr carbonitrides, Laves phases, etc.) precipitate at the time of high temperature heating by virtue of the added elements. These easily precipitate and grow at the crystal grain boundaries. If precipitates finely precipitate, the high temperature strength is improved by the action of the precipitation strengthening. However, in general grain boundary precipitates easily become coarser, and therefore there is almost no ability to strengthen the high temperature strength. On the other hand, precipitates at the twin boundaries have low interfacial energy, and therefore the precipitates are more difficult to become coarsened compared with general grain boundaries. As a result, the inventors discovered that precipitation strengthening by precipitates precipitating at the twin boundaries is maintained at a high temperature and that the precipitation strengthening ability after the precipitates being exposed to a high temperature for a long time is also relatively high. Further, when a frequency of twin boundaries is 60% or more, the 0.2% yield strength at 900° C. reaches about 80 MPa, and therefore the upper limit of the annealing twin frequency is made to be 60%.

Furthermore, from the viewpoint of the high temperature creep or fatigue, 80% or more is preferable.

Next, the ranges of constituents of the austenitic stainless steel of the present invention will be explained, as follows. The lower limit of C is made 0.005% so as to form an austenite structure and secure high temperature strength. On the other hand, excessive addition invites hardening. In addition, formation of Cr carbides causes deterioration of the corrosion resistance, in particular deterioration of intergranular corrosion resistance of weld zones. In addition, the excessive addition causes deterioration of sliding property at high temperature due to carbides, and intergranular corrosion grooves are formed at the time of pickling the cold rolled annealed sheet, and thereby the surface roughness of the cold rolled annealed sheet is coarsened. Further, the upper limit of C is made 0.2% because C raises the stacking fault energy and lowers the annealing twin frequency. Furthermore, if considering the manufacturing costs and hot workability, the content of C is preferably 0.008% to 0.15%.

Si is sometimes added as a deoxidizing element. In addition, internal oxidation caused by Si enables an improvement in the oxidation resistance and sliding property at high temperature and an improvement of the high temperature strength due to increase in the annealing twin frequency. Therefore, 0.1% or more is added. On the other hand, addition of 4.0% or more causes hardening and formation of coarse Si-based oxides. The precision of processing the component remarkably falls. Therefore, the upper limit is made 4%. Further, if considering the manufacturing costs, the acid pickling property at the time of manufacture of the steel sheet and the solidification crack susceptibility at the time of welding, the content of Si is preferably 0.4% to 3.5%. From the viewpoint of stacking fault energy, preferably the lower limit is made over 1.0% and the upper limit is made less than 3.5%. Furthermore, if considering the sliding property at high temperature, 2.0% to less than 3.5% is preferable.

Mn is utilized as a deoxidizing element and also forms an austenite structure and secures scale adhesion. Further, 0.1% or more is added so as to lower the stacking fault energy and cause an increase in the annealing twin frequency. On the other hand, with addition of over 10%, the inclusion cleanliness is remarkably deteriorated and the hole expandability falls. In addition, the acid pickling property remarkably deteriorates and the product surface becomes rough. For this reason, the upper limit is made 10%. Further, in the invention steels, if contained over 10%, a drop in the annealing twin frequency is invited. Furthermore, if considering the manufacturing costs and the acid pickling property at the time of steel sheet manufacture, the content of Mn is preferably 0.2% to 5%. From the viewpoint of the abnormal oxidation characteristic, it is preferably 0.2% to 3%.

Ni is an element forming an austenite structure and an element securing corrosion resistance and oxidation resistance. Further, if less than 2%, remarkable coarsening of the crystal grains ends up occurring. Therefore, 2% or more is added. Further, 2% or more is necessary for sufficiently forming crystal twinning. On the other hand, excessive addition invites a rise in costs and a fall in annealing twin frequency, so the upper limit is made 25%. Furthermore, if considering the manufacturability, ductility at room temperature, and corrosion resistance, the content of Ni is preferably 7% to 20%.

Cr is an element improving the corrosion resistance, oxidation resistance, and sliding property at high temperature. If considering the environment of exhaust components, it is an element required from the viewpoint of suppressing abnormal oxidation. Further, 15% or more is required for sufficiently forming crystal twinning. On the other hand, excessive addition results in hardening and causes deterioration of the formability and, in addition, leads to higher costs, so the upper limit is made 30%. Furthermore, if considering the manufacturing costs, steel sheet manufacturability, and workability, the content of Cr is preferably 17% to 25.5%.

N, like C, is an element effective for forming an austenite structure and securing high temperature strength and a sliding property at high temperature. For high temperature strength, it is known as a solid solution strengthening element, but further N is also effective for forming crystal twinning. In the present application, aside from the effects of N alone, in view of high temperature strength by virtue of clustering with Cr, 0.01% or more is added. On the other hand, by addition over 0.4%, the material at room temperature remarkably hardens and the cold workability at the stage of manufacture of the steel sheet deteriorates. In addition, the formability at the time of processing the component and the parts precision deteriorate. Therefore, the upper limit is made 0.4%. Further, from the viewpoint of softening, suppressing pinholes at the time of welding and suppressing intergranular corrosion of weld zones, the content of N is preferably 0.02% to 0.35%. Furthermore, from the viewpoint of the high temperature strength, sliding property, and ductility at room temperature, over 0.04% to less than 0.4% is preferable. Further, from the viewpoint of the creep characteristic, the content of N is preferably over 0.15% to less than 0.4%.

Al is added as a deoxidizing element and improves the inclusion cleanliness to thereby improve the hole expandability. In addition, it has the effect of suppressing peeling of oxide scale and contributing to improvement of the sliding property at high temperature by a slight amount of internal oxidation. This action appears from 0.001%, so the lower limit is 0.001%. Further, this is a ferrite-forming element. Therefore, with addition of 1% or more, the austenite structure falls in stability. Also, an increase in the surface roughness is invited due to the drop in the acid pickling property. Therefore, the upper limit is 1%. Furthermore, if considering the refining costs and surface defects, the content of Al is preferably 0.007% to 0.5%. From the viewpoint of the weldability, 0.01% to 0.1% is more preferable.

Cu is an element effective for stabilization of the austenite phases and softening. 0.05% or more is added. On the other hand, excessive addition leads to deterioration of the oxidation resistance and deterioration of the manufacturability, so the upper limit is made 4.0%. Further, in the invention steels, if over 4.0% is contained, a drop in the annealing twin frequency is invited. Furthermore, if considering the corrosion resistance and manufacturability, the content of Cu is preferably 0.3% to 1%.

Mo is an element improving the corrosion resistance and contributes to improvement of the high temperature strength. The high temperature strength is improved mainly by solid solution strengthening, but this is an element promoting the precipitation of the σ phases etc, so this also contributes to fine precipitation strengthening at the twin boundaries. In the present invention, to make use of not only solid solution strengthening, but also precipitation strengthening by Mo carbides, the lower limit is made 0.02%. However, excessive addition causes a drop in the annealing twin frequency, so the upper limit is made 3%. Furthermore, if considering the fact that Mo is an expensive element and the stability of strengthening by the above precipitates and inclusion cleanliness, the content of Mo is preferably 0.4% to 1.6%. In order for the abnormal oxidation to prevent from being caused, 0.4% to 1.0% is more preferable.

V is an element improving the corrosion resistance. Further, to promote the formation of V carbides and σ phases and improve the high temperature strength, 0.02% or more is added. On the other hand, excessive addition invites an increase in alloy costs and a drop in the lower limit temperature wherein the abnormal oxidation is caused. Therefore, the upper limit is made 1%. Furthermore, if considering the manufacturability and inclusion cleanliness, the content of V is preferably 0.1% to 0.5%.

P is an impurity. It is an element which assists hot workability at the time of manufacture and solidification crack susceptibility and also causes hardening and reduction of ductility, so the smaller the content the better, but if considering the refining costs, it may be contained in a range of an upper limit of 0.05% and a lower limit of 0.01%. Furthermore, if considering the manufacturing costs, the content of P is preferably 0.02% to 0.04%.

S is an impurity. It is also element which causes a drop in the hot workability at the time of manufacture and also causes deterioration of the corrosion resistance. Further, coarse sulfides (MnS) are formed, the inclusion cleanliness remarkably worsens, and the ductility at room temperature is caused to deteriorate. Therefore, this may be contained with an upper limit of 0.01%. On the other hand, excessive reduction leads to an increase in the refining costs, so this may be contained with a lower limit of 0.0001%. Furthermore, if considering the manufacturing costs and the oxidation resistance, the content of S is preferably 0.0005% to 0.0050%.

The austenitic stainless steel sheet for an exhaust component of the invention may contain the following constituents in addition to the above-mentioned elements.

Ti is an element which is added to bond with C and N to improve the corrosion resistance and intergranular corrosion resistance. The action of fixing C and N is manifested from 0.005%, so Ti may be added as needed with a lower limit of 0.005%. Further, with addition over 0.3%, nozzle clogging easily occurs at the casting stage and the manufacturability is remarkably degraded. In addition, coarse Ti carbonitrides invite deterioration of the ductility. Therefore, the upper limit is made 0.3%. Furthermore, in view of the high temperature strength, intergranular corrosion resistance of the weld zone, and alloy costs, the content of Ti is preferably 0.01% to 0.2%. Further, from the viewpoint of the creep characteristic, the content of Ti is preferably over 0.03% to 0.3%.

Nb, like Ti, is an element which bonds with C and N to improve the corrosion resistance and the intergranular corrosion resistance and also improves high temperature strength. In addition to the action of fixing C and N, the improvement of the high temperature strength by the solid solution Nb and improvement of the strength by twin boundary precipitation of the Laves phases at twin boundaries are caused from 0.005%. Therefore, if necessary, Nb may be added with a lower limit of 0.005%. Further, with addition over 0.3%, the hot workability at the manufacturing stage of steel sheet is remarkably degraded and also coarse Nb carbonitrides invite a deterioration of the ductility, so the upper limit is made 0.3%. Furthermore, if considering the high temperature strength, the intergranular corrosion of the weld zones, and the alloy costs, the content of Nb is preferably 0.01 to 0.20%. Further, from the viewpoint of the creep characteristic, the content of Nb is preferably over 0.005% to 0.05%.

B is an element improving the hot workability at the stage of manufacturing the steel sheet. It may be added as needed in 0.0002% or more. Further, B also acts to increase the strength by precipitation of B at the twin boundaries. However, excessive addition causes a drop in inclusion cleanliness and ductility and deterioration of the intergranular corrosion by the formation of boron carbides, so the upper limit was made 0.005%. Furthermore, if considering the refining cost and drop in ductility, the content of B is preferably 0.0003% to 0.003%.

Ca is added according to need for desulfurization. This action is not caused at less than 0.0005%. Therefore, if necessary, this may be added with a lower limit of 0.0005%. Further, if adding over 0.01%, the water soluble inclusions CaS are formed and a drop in inclusion cleanliness and a remarkable drop in corrosion resistance are invited, so the upper limit is made 0.01%. Furthermore, from the viewpoints of the manufacturability and surface quality, the content of Ca is preferably 0.0010% to 0.0030%.

W contributes to improvement of the corrosion resistance and the high temperature strength, so may be added as needed at 0.1% or more. Addition of over 3% leads to hardening, deterioration of the toughness at the time of manufacture of the steel sheet, and an increase in costs, so the upper limit is made 3%. Furthermore, if considering the refining costs and manufacturability, the content of W is preferably 0.1% to 2%. If considering the abnormal oxidation characteristic, 0.1% to 1.5% is more preferable.

Zr bonds with C and N to improve the intergranular corrosion of the weld zone and oxidation resistance, so may be added as needed at 0.05% or more. However, addition over 0.3% causes an increase in costs and also remarkably degrades the manufacturability and hole expandability, so the upper limit is made 0.3%. Furthermore, if considering the refining costs and manufacturability, the content of Zr is preferably 0.05% to 0.1%.

Sn contributes to improvement of the corrosion resistance and high temperature strength, so may be added as needed at 0.01% or more. The effect becomes remarkable at 0.03% or more and becomes further remarkable at 0.05% or more. Addition over 0.5% sometimes causes the occurrence of slab cracks at the time of manufacture of the steel sheet, so the upper limit is made 0.5%. Furthermore, if considering the refining costs and manufacturability, the content of Sn is preferably 0.05% to 0.3%.

Co contributes to improvement of the high temperature strength, so may be added as needed at 0.03% or more. Addition over 0.3% leads to hardening, deterioration of the toughness at the time of manufacture of the steel sheet, and increased costs, so the upper limit is made 0.3%. Furthermore, if considering the refining costs and manufacturability, the content of Co is preferably 0.03% to 0.1%.

Mg is an element which is sometimes added as a desulfurizing element and also contributes to improvement of the inclusion cleanliness and refinement of the structure by refining and dispersing oxides in the slab structure. The effect of Mg is obtained from 0.0002% or more. Therefore, if necessary, Mg may be added with a lower limit of 0.0002%. However, excessive addition leads to deterioration of the weldability and corrosion resistance and a drop in the hole expandability by coarse inclusions. Therefore, the upper limit is made 0.01%. In view of the refining costs and manufacturability, the content of Mg is preferably 0.0003% to 0.005%.

Sb is an element which segregates at the grain boundaries to act to improve the high temperature strength. To obtain the effect of addition, it may be added as needed to 0.005% or more. However, if over 0.3%, Sb segregation is caused and cracking is caused at the time of welding. Therefore, the upper limit is made 0.3%. In view of the high temperature characteristic and the manufacturing costs and toughness, the content of Sb is preferably 0.03% to 0.3%, more preferably 0.05% to 0.2%.

An REM (rare earth element) is effective for improvement of the oxidation resistance and the sliding ability property at high temperature and may be added as needed at 0.002% or more. Further, even if added in over 0.2%, the effect of REM becomes saturated and the corrosion resistance drops by virtue of the sulfides of REM. Therefore, 0.002% to 0.2% is added. In view of the workability of the product and the manufacturing costs, the lower limit is preferably made 0.002% and the upper limit is made 0.10%. Further, "REM" (rare earth element) is as generally defined. It is the overall name for the two elements of scandium (Sc) and yttrium (Y) and the 15 elements from lanthanum (La) to lutetium (Lu) (lanthanoids). They may be added individually or may be mixtures.

Ga improves the corrosion resistance and suppresses hydrogen embrittlement. Therefore, Ga may be added as needed at 0.3% or less. However, addition of Ga over 0.3% causes formation of coarse sulfides and deterioration of the r-value. From the viewpoint of formation of sulfides and hydrides, the lower limit is made 0.0002%. Furthermore, from the viewpoints of manufacturability and costs, 0.002% or more is more preferable.

Other constituents are not particularly prescribed in the present invention. However, Ta and Hf may be added at 0.01% to 1.0% for improving the high temperature strength. Further, Bi may be included as needed at 0.001 to 0.02%. Note that As, Pb, and other general harmful elements and impurity elements are preferably decreased as much as possible.

Next, the method of production will be explained. The method of production of steel sheet of the present invention comprises steelmaking, hot rolling, annealing, pickling, cold rolling, annealing, and pickling.

In steelmaking, steel containing the above essential constituents and constituents added as required is preferably smelted in an electric furnace or smelted in a converter and then secondarily refined. The smelted molten steel is made into a slab by a known casting method (continuous casting) then a known hot rolling method is used to heat the slab to a predetermined temperature and hot roll it to a predetermined thickness by continuous rolling. In this way, the manufacturing conditions in the hot rolling step and on are set according to a known method so as to secure predetermined crystal grain size, cross-sectional hardness, and surface roughness in the components covered by the present invention.

The steel sheets after hot rolling are annealed and pickled, then cold rolled by a reduction of 60% or less. This is because if the reduction becomes over 60%, recrystallization excessively progresses in the subsequent annealing step, random grain boundaries increase, and annealing twins are obstructed. If considering the ductility of the material, the crystal grain size should be coarse. If considering the manufacturability and sheet shape, the reduction is preferably 2 to 30%.

Next, a new annealing method for increasing twin boundaries when annealing cold rolled steel sheet reduced to predetermined thicknesses was discovered by the inventors. Specifically, this is characterized by making the heating rate up to 900° C. In annealing the cold rolled sheet less than 10° C./sec, making the heating rate from 900° C. or more 10° C./sec or more, and making the highest temperature 1000 to 1200° C.

By making the heating rate low in the temperature region up to 900° C., the formation of twin boundaries is made to increase at a temperature region where recrystallization does not occur, while by heating at a fast speed in the region of 900° C. or more, the metal structure of the steel sheet is made a recrystallized structure. By heating by a heating rate of less than 10° C./sec in the temperature region up to 900° C., migration of recrystallization boundaries becomes easy and twin boundaries can be prevented from being eroded by recrystallization boundaries. In view of the ductility of the material, the crystal grain size is preferably coarse, so the highest temperature is made 1000 to 1200° C. Furthermore, to prevent a recrystallized structure and increase the frequency of twinning, the highest temperature is preferably 1030 to 1130° C. If lengthening the holding time at the highest temperature, the twin boundaries end up disappearing at the stage of grain growth of the recrystallized grains, so the holding time at the highest temperature is preferably made 30 sec or less.

In the present application, by cold rolling after annealing and pickling the hot rolled sheet, then annealing and pickling the cold rolled sheet, a further smoother surface is obtained. The cold rolling step may be performed by tandem rolling, a Sendzimer rolling mill, a cluster rolling mill, etc. For functions and applications such as turbocharger components, in general, products with surface finish numbers of either "2B" or "2D" are used. However, when high surface smoothness or gloss is demanded, bright annealing may be performed after cold rolling to obtain a product with a surface finish number of either "BA". The pickling is suitably selected from pretreatment such as neutral salt electrolysis or molten alkali treatment or nitrofluoric acid or nitric acid electrolysis.

EXAMPLES

Steels of the chemical compositions shown in Table 1-1 and Table 1-2 were smelted and cast into slabs, then hot rolled and annealed and pickled, then cold rolled and final annealed under the conditions shown in Table 2-1 and Table 2-2 and further pickled to obtain 2.0 mm thick finished sheets. Note that, the values in the columns with asterisks "*" attached in Table 1-2 show the corresponding constituents do not meet the requirements of the present invention. Further, the values in the columns with asterisks "*" attached in Table 1-2 show the corresponding manufacturing conditions do not meet the requirements of the method of production of the present invention.

The finished sheets shown in Table 2-1 and Table 2-2 were measured for the annealing twin frequency (%) by the method described above and were subjected to high temperature tensile tests at 900° C. by the method described above. Further, the ductility at room temperature was measured by taking as a tensile test piece a JIS No. 13B test piece so that the rolling direction became the tensile direction, conducting a tensile test at a strain rate of $10^{-3}$/sec, and measuring the elongation at break.

The test results and results of measurement of the finished sheets shown in Table 2-1 and Table 2-2 are shown in Table 2-1 and Table 2-2. Note that, the values with asterisks "*" attached in Table 2-2 in the column "Annealing twin frequency (%)" show the requirement of the annealing twin frequency in the present invention was not met. Further, the values with asterisks "*" attached in Table 2-2 in the column "0.2% yield strength at 900° C. (MPa)" show less than 70 MPa. Further, the values with asterisks "*" attached in Table 2-2 in the column "Room temperature ductility (%)" show the ductility at room temperature is less than 40%.

Further, the finished sheets shown in Table 2-1 and Table 2-2 were shaped into housings of turbochargers. The quality of the formability at this time is shown in the columns of "Judgment of formability to component shape" in Table 2-1 and Table 2-2. Further, in the fields of those columns, "Good" indicates the process of shaping the sheet into the housing of a turbocharger went well, while "Poor" indicates application as a housing was not possible. For the specific method of judgment, the judgment criteria were the presence of any cracks in the shaped articles and the rate of decrease of sheet thickness (30% or less being passing).

Furthermore, the housings of the turbochargers obtained by shaping the finished sheets shown in Table 2-1 and Table 2-2 were repeatedly heated (900° C.) and cooled (150° C.). The state of deformation and presence of any oxidation damage after 2000 cycles were confirmed. The results are shown in the "Judgment of degree of deformation in endurance test" and "Presence of any oxidation damage in endurance test" of Table 2-1 and Table 2-2. Further, an example with little degree of deformation after the endurance test compared with before the endurance test is shown as "Good" while one with a large degree is shown as "Poor". Here, the degree of deformation in the endurance test is judged as passing (Good) when comparing the shapes of housings before and after endurance tests by for example a 3D shape measuring device etc. and the rate of change of shape is within ±3% and as failing (Poor) when over ±3%. Further, examples where no oxidation damage such as abnormal oxidation or scale peeling could be found visually after the endurance tests are shown as "Good" and ones where oxidation damage could be found are shown as "Poor".

As a result of manufacture under the manufacturing conditions shown in Table 2-1, it is confirmed that the steels of the invention examples (Examples 1 to 23) are excellent in workability and heat resistance.

As opposed to this, as shown in Table 2-2, in the steels of Comparative Examples 1 to 28, the ductilities at room temperature were often less than 40%. In this way, finished sheets with ductilities at room temperature of less than 40% are poor in formability to the housings of turbochargers and cannot be applied as housings. Further, the comparative steels featured excessive deformation in the endurance tests and were poor in exhaust performance or caused damage to the turbochargers due to contact with other components when applied to housings and therefore cannot be used for turbochargers. Furthermore, if abnormal oxidation or scale peeling occurs or reduction of thickness occurs in the endurance tests, this leads to damage to the later catalysts or damage to the housings due to peeling scale, but the present invention was not found to suffer from oxidation damage. Further, in some of the comparative examples, there was severe oxidation damage and function as a housing could not be achieved.

From the above, it is confirmed that the invention examples are satisfactory in terms of formability into housings, low level of deformation in subsequent endurance tests, and performance of turbochargers.

TABLE 1-1

| | | Chemical composition (mass %) | | | | | | | | | | | | |
|---|---|---|---|---|---|---|---|---|---|---|---|---|---|---|
| | No. | C | Si | Mn | P | S | Ni | Cr | N | Al | Cu | Mo | V | Selective additive elements |
| Inv. | A1 | 0.048 | 3.31 | 0.92 | 0.026 | 0.0010 | 13.90 | 19.0 | 0.021 | 0.007 | 0.21 | 0.12 | 0.10 | — |
| ex. | A2 | 0.041 | 3.28 | 0.86 | 0.032 | 0.0008 | 13.85 | 19.2 | 0.019 | 0.032 | 0.19 | 0.17 | 0.13 | Ca: 0.004 |
| | A3 | 0.098 | 1.91 | 1.42 | 0.031 | 0.0005 | 13.10 | 24.1 | 0.240 | 0.040 | 0.20 | 0.58 | 0.11 | Ca: 0.006 |
| | A4 | 0.031 | 1.95 | 0.71 | 0.022 | 0.0021 | 10.30 | 17.9 | 0.052 | 0.051 | 2.10 | 0.65 | 0.15 | — |
| | A5 | 0.010 | 0.50 | 2.70 | 0.030 | 0.0020 | 8.10 | 17.4 | 0.010 | 0.010 | 2.70 | 0.10 | 0.10 | — |
| | A6 | 0.040 | 0.50 | 1.10 | 0.030 | 0.0006 | 19.20 | 25.3 | 0.030 | 0.030 | 0.20 | 0.15 | 0.23 | B: 0.0005 |
| | A7 | 0.032 | 3.12 | 0.95 | 0.016 | 0.0009 | 13.50 | 19.1 | 0.045 | 0.012 | 0.15 | 0.05 | 0.18 | — |
| | A8 | 0.013 | 3.21 | 3.50 | 0.016 | 0.0006 | 7.50 | 18.8 | 0.190 | 0.092 | 1.20 | 0.05 | 0.16 | — |
| | A9 | 0.052 | 3.10 | 1.20 | 0.042 | 0.0043 | 13.10 | 19.1 | 0.153 | 0.023 | 0.15 | 0.05 | 0.82 | Ca: 0.004, REM: 0.015 |
| | A10 | 0.052 | 2.90 | 1.32 | 0.035 | 0.0034 | 12.90 | 18.7 | 0.180 | 0.043 | 0.15 | 0.15 | 0.13 | Nb: 0.15 |
| | A11 | 0.040 | 0.28 | 0.84 | 0.028 | 0.0007 | 17.26 | 25.8 | 0.210 | 0.046 | 0.26 | 1.53 | 0.26 | Ca: 0.005, Mg: 0.001 |
| | A12 | 0.153 | 2.13 | 1.53 | 0.031 | 0.0005 | 12.10 | 24.1 | 0.353 | 0.054 | 0.20 | 0.58 | 0.11 | Ti: 0.15 |
| | A13 | 0.020 | 1.87 | 0.56 | 0.022 | 0.0005 | 10.03 | 17.8 | 0.031 | 0.025 | 1.79 | 0.22 | 0.53 | W: 0.45 |
| | A14 | 0.026 | 1.93 | 1.15 | 0.029 | 0.0006 | 10.13 | 19.5 | 0.045 | 0.951 | 0.39 | 0.33 | 0.39 | Ga: 0.0010 |
| | A15 | 0.015 | 3.85 | 0.82 | 0.026 | 0.0005 | 13.12 | 17.2 | 0.049 | 0.016 | 0.19 | 0.45 | 0.19 | Sn: 0.11 |
| | A16 | 0.098 | 1.91 | 1.42 | 0.031 | 0.0005 | 12.10 | 24.1 | 0.390 | 0.040 | 0.20 | 0.58 | 0.11 | Ca: 0.006, Nb: 0.15 |
| | A17 | 0.021 | 3.35 | 2.93 | 0.035 | 0.0016 | 6.30 | 16.8 | 0.120 | 0.021 | 0.25 | 0.25 | 0.25 | Zr: 0.08 |
| | A18 | 0.051 | 0.52 | 0.53 | 0.015 | 0.0006 | 23.50 | 25.9 | 0.016 | 0.0051 | 0.15 | 0.22 | 0.13 | — |
| | A19 | 0.048 | 3.21 | 0.92 | 0.016 | 0.0010 | 13.80 | 19.1 | 0.020 | 0.007 | 0.06 | 0.12 | 0.20 | — |
| | A20 | 0.047 | 3.15 | 0.82 | 0.026 | 0.0005 | 13.50 | 19.5 | 0.011 | 0.007 | 0.06 | 0.03 | 0.10 | Ti: 0.005 |
| | A21 | 0.048 | 3.31 | 0.92 | 0.026 | 0.0010 | 13.90 | 19.0 | 0.021 | 0.007 | 0.21 | 0.12 | 0.03 | Nb: 0.005 |
| | A22 | 0.130 | 2.55 | 0.84 | 0.021 | 0.0005 | 7.23 | 25.1 | 0.305 | 0.054 | 0.08 | 0.05 | 0.09 | Ti: 0.30 |
| | A23 | 0.093 | 2.05 | 1.53 | 0.021 | 0.0005 | 7.88 | 24.1 | 0.332 | 0.040 | 0.09 | 0.06 | 0.02 | Nb: 0.30 |

TABLE 1-2

| | No. | Chemical composition (mass %) | | | | | | | | | | | | |
|---|---|---|---|---|---|---|---|---|---|---|---|---|---|---|
| | | C | Si | Mn | P | S | Ni | Cr | N | Al | Cu | Mo | V | Selective additive elements |
| Comp. ex. | B1 | 0.251* | 3.26 | 0.25 | 0.020 | 0.0009 | 13.80 | 19.3 | 0.023 | 0.016 | 0.15 | 0.12 | 0.10 | — |
| | B2 | 0.033 | 4.52* | 0.58 | 0.025 | 0.0009 | 11.20 | 19.8 | 0.033 | 0.032 | 0.16 | 0.17 | 0.13 | — |
| | B3 | 0.026 | 3.13 | 10.84* | 0.020 | 0.0012 | 13.56 | 19.2 | 0.035 | 0.013 | 0.25 | 0.58 | 0.11 | — |
| | B4 | 0.013 | 0.65 | 2.86 | 0.062* | 0.0002 | 8.53 | 17.7 | 0.013 | 0.026 | 0.17 | 0.65 | 0.15 | — |
| | B5 | 0.036 | 1.95 | 1.42 | 0.028 | 0.013* | 12.50 | 25.3 | 0.210 | 0.033 | 0.22 | 0.10 | 0.10 | — |
| | B6 | 0.034 | 2.56 | 1.56 | 0.030 | 0.0026 | 1.1* | 18.9 | 0.026 | 0.042 | 0.36 | 0.15 | 0.23 | — |
| | B7 | 0.056 | 0.64 | 1.03 | 0.022 | 0.0015 | 9.53 | 13.8* | 0.036 | 0.035 | 0.26 | 0.05 | 0.18 | — |
| | B8 | 0.054 | 0.75 | 0.76 | 0.032 | 0.0053 | 18.03 | 19.5 | 0.46* | 0.033 | 1.32 | 0.13 | 0.16 | — |
| | B9 | 0.073 | 2.38 | 0.88 | 0.013 | 0.0012 | 18.30 | 20.6 | 0.232 | 0.026 | 4.6* | 0.15 | 0.25 | — |
| | B10 | 0.021 | 1.79 | 1.03 | 0.040 | 0.0033 | 9.86 | 17.6 | 0.195 | 0.022 | 0.15 | 3.89* | 0.26 | — |
| | B11 | 0.023 | 0.75 | 1.02 | 0.027 | 0.0032 | 10.35 | 25.5 | 0.205 | 0.023 | 0.15 | 0.58 | 2.68* | — |
| | B12 | 0.025 | 1.78 | 0.86 | 0.012 | 0.0013 | 10.45 | 25.6 | 0.086 | 0.040 | 0.36 | 0.22 | 0.53 | Ti: 0.51* |
| | B13 | 0.019 | 1.09 | 1.34 | 0.027 | 0.0023 | 11.22 | 25.1 | 0.043 | 0.056 | 0.16 | 0.33 | 0.39 | Nb: 0.53* |
| | B14 | 0.023 | 2.32 | 0.73 | 0.028 | 0.0016 | 7.12 | 23.0 | 0.041 | 0.030 | 0.17 | 0.45 | 0.19 | B: 0.008* |
| | B15 | 0.056 | 3.13 | 1.01 | 0.030 | 0.0022 | 18.53 | 25.3 | 0.036 | 0.076 | 0.29 | 0.25 | 0.25 | Ca: 0.016* |
| | B16 | 0.042 | 1.65 | 1.55 | 0.030 | 0.0007 | 17.79 | 16.3 | 0.165 | 0.033 | 0.25 | 0.05 | 0.16 | W: 3.33* |
| | B17 | 0.055 | 3.26 | 1.16 | 0.050 | 0.0011 | 12.32 | 19.8 | 0.036 | 0.165 | 0.21 | 0.05 | 0.82 | Zr: 0.55* |
| | B18 | 0.026 | 0.53 | 2.16 | 0.027 | 0.0025 | 12.20 | 19.2 | 0.076 | 0.365 | 0.66 | 0.15 | 0.13 | Sn: 0.73* |
| | B19 | 0.034 | 2.60 | 0.96 | 0.012 | 0.0024 | 8.43 | 19.5 | 0.232 | 0.025 | 0.68 | 1.53 | 0.26 | Co: 0.84* |
| | B20 | 0.046 | 0.56 | 0.97 | 0.027 | 0.0011 | 8.03 | 17.2 | 0.053 | 0.026 | 1.25 | 0.58 | 0.11 | Mg: 0.018* |
| | B21 | 0.086 | 0.86 | 0.45 | 0.028 | 0.0360* | 9.35 | 18.4 | 0.016 | 0.035 | 1.26 | 0.22 | 0.53 | Sb: 0.63* |
| | B22 | 0.015 | 0.64 | 0.56 | 0.030 | 0.0011 | 9.56 | 22.6 | 0.025 | 0.045 | 0.16 | 0.33 | 0.39 | REM: 0.35* |
| | B23 | 0.023 | 0.75 | 0.59 | 0.010 | 0.0025 | 13.28 | 24.5 | 0.036 | 0.059 | 0.25 | 0.65 | 0.15 | Ga: 0.55* |
| | B24 | 0.032 | 2.15 | 0.98 | 0.010 | 0.0023 | 13.28 | 25.5 | 0.400* | 0.050 | 0.15 | 0.35 | 0.10 | — |

TABLE 2-1

| | | | Annealing conditions of cold rolled sheet | | | Characteristics of produced sheet | | | Performance of turbocharger | | |
|---|---|---|---|---|---|---|---|---|---|---|---|
| Ex. no. | Steel no. | Cold rolling conditions Reduction (%) | Heating rate up to 900° C. (° C./sec) | Heating rate from 900° C. (° C./sec) | Highest temp. (° C.) | Annealing twin frequency (%) | 0.2% yield strength at 900° C. (MPa) | Ductility at room temperature (%) | Judgment of formability to component shape | Judgment of degree of deformation in endurance test | Presence of oxidation damage in endurance test |
| Ex. 1 | A1 | 5 | 9 | 20 | 1030 | 71 | 73 | 53 | Good | Good | None |
| Ex. 2 | A2 | 50 | 9 | 38 | 1020 | 62 | 70 | 54 | Good | Good | None |
| Ex. 3 | A3 | 15 | 9 | 41 | 1050 | 85 | 80 | 45 | Good | Good | None |
| Ex. 4 | A4 | 25 | 7 | 20 | 1020 | 53 | 71 | 52 | Good | Good | None |
| Ex. 5 | A5 | 5 | 5 | 25 | 1100 | 64 | 75 | 50 | Good | Good | None |
| Ex. 6 | A6 | 3 | 9 | 26 | 1050 | 40 | 70 | 52 | Good | Good | None |
| Ex. 7 | A7 | 5 | 9 | 36 | 1150 | 53 | 72 | 51 | Good | Good | None |
| Ex. 8 | A8 | 3 | 7 | 31 | 1050 | 52 | 71 | 52 | Good | Good | None |
| Ex. 9 | A9 | 5 | 9 | 13 | 1150 | 75 | 76 | 50 | Good | Good | None |
| Ex. 10 | A10 | 26 | 9 | 25 | 1020 | 66 | 83 | 41 | Good | Good | None |
| Ex. 11 | A11 | 10 | 5 | 30 | 1100 | 70 | 77 | 48 | Good | Good | None |
| Ex. 12 | A12 | 33 | 4 | 13 | 1050 | 83 | 81 | 42 | Good | Good | None |
| Ex. 13 | A13 | 5 | 9 | 25 | 1150 | 86 | 79 | 46 | Good | Good | None |
| Ex. 14 | A14 | 43 | 8 | 18 | 1100 | 72 | 73 | 49 | Good | Good | None |
| Ex. 15 | A15 | 5 | 9 | 28 | 1050 | 85 | 76 | 50 | Good | Good | None |
| Ex. 16 | A16 | 2 | 7 | 17 | 1020 | 76 | 77 | 50 | Good | Good | None |
| Ex. 17 | A17 | 25 | 9 | 15 | 1020 | 62 | 71 | 52 | Good | Good | None |
| Ex. 18 | A18 | 50 | 8 | 13 | 1100 | 81 | 80 | 50 | Good | Good | None |
| Ex. 19 | A19 | 5 | 9 | 20 | 1120 | 41 | 70 | 53 | Good | Good | None |
| Ex. 20 | A20 | 5 | 6 | 25 | 1020 | 58 | 76 | 53 | Good | Good | None |
| Ex. 21 | A21 | 5 | 9 | 20 | 1120 | 55 | 72 | 53 | Good | Good | None |
| Ex. 22 | A22 | 8 | 4 | 10 | 1100 | 80 | 88 | 40 | Good | Good | None |
| Ex. 23 | A23 | 8 | 4 | 10 | 1100 | 78 | 88 | 40 | Good | Good | None |

TABLE 2-2

| Comp. ex. no. | Steel no. | Cold rolling conditions Reduction (%) | Annealing conditions of cold rolled sheet: Heating rate up to 900° C. (° C./sec) | Heating rate from 900° C. (° C./sec) | Highest temp. (° C.) | Characteristics of produced sheet: Annealing twin frequency (%) | 0.2% yield strength at 900° C. (MPa) | Ductility at room temperature (%) | Performance of turbocharger: Judgment of formability to component shape | Judgment of degree of deformation in endurance test | Presence of oxidation damage in endurance test |
|---|---|---|---|---|---|---|---|---|---|---|---|
| Comp. Ex. 1 | A1 | 70* | 9 | 20 | 1120 | 35* | 68* | 53 | Good | Poor | None |
| Comp. Ex. 2 | A2 | 50 | 15* | 38 | 1120 | 34* | 66* | 54 | Good | Poor | None |
| Comp. Ex. 3 | A3 | 50 | 9 | 8* | 1150 | 38* | 69* | 45 | Good | Poor | None |
| Comp. Ex. 4 | A4 | 55 | 7 | 20 | 1250* | 25* | 61* | 52 | Good | Poor | None |
| Comp. Ex. 5 | B1 | 43 | 9 | 36 | 1150 | 40 | 70 | 35* | Poor | Good | None |
| Comp. Ex. 6 | B2 | 50 | 5 | 31 | 1120 | 41 | 71 | 33* | Poor | Good | None |
| Comp. Ex. 7 | B3 | 38 | 4 | 13 | 1100 | 30* | 65* | 50 | Good | Poor | None |
| Comp. Ex. 8 | B4 | 50 | 9 | 25 | 1150 | 41 | 71 | 33* | Poor | Good | None |
| Comp. Ex. 9 | B5 | 26 | 8 | 30 | 1150 | 46 | 77 | 39* | Poor | Good | None |
| Comp. Ex. 10 | B6 | 15 | 9 | 13 | 1150 | 14* | 30* | 30* | Poor | Poor | None |
| Comp. Ex. 11 | B7 | 43 | 7 | 25 | 1150 | 4* | 22* | 36* | Poor | Poor | Yes |
| Comp. Ex. 12 | B8 | 50 | 9 | 25 | 1120 | 50 | 80 | 30* | Poor | Poor | Yes |
| Comp. Ex. 13 | B9 | 50 | 7 | 13 | 1120 | 30* | 66* | 50 | Good | Poor | Yes |
| Comp. Ex. 14 | B10 | 55 | 5 | 25 | 1150 | 35* | 57* | 38* | Poor | Good | Yes |
| Comp. Ex. 15 | B11 | 50 | 9 | 18 | 1120 | 40 | 70 | 37* | Poor | Good | Yes |
| Comp. Ex. 16 | B12 | 50 | 9 | 28 | 1100 | 42 | 72 | 36* | Poor | Good | Yes |
| Comp. Ex. 17 | B13 | 55 | 7 | 17 | 1150 | 56 | 79 | 34* | Poor | Good | None |
| Comp. Ex. 18 | B14 | 50 | 9 | 15 | 1150 | 45 | 75 | 35* | Poor | Good | Yes |
| Comp. Ex. 19 | B15 | 43 | 9 | 41 | 1150 | 41 | 71 | 39* | Poor | Good | Yes |
| Comp. Ex. 20 | B16 | 50 | 9 | 20 | 1120 | 50 | 80 | 34* | Poor | Good | Yes |
| Comp. Ex. 21 | B17 | 15 | 7 | 25 | 1100 | 42 | 73 | 39* | Poor | Good | None |
| Comp. Ex. 22 | B18 | 43 | 5 | 26 | 1150 | 46 | 79 | 30* | Poor | Good | Yes |
| Comp. Ex. 23 | B19 | 50 | 9 | 36 | 1150 | 43 | 72 | 38* | Poor | Good | None |
| Comp. Ex. 24 | B20 | 43 | 9 | 31 | 1100 | 44 | 75 | 35* | Good | Good | Yes |
| Comp. Ex. 25 | B21 | 50 | 7 | 13 | 1150 | 42 | 73 | 35* | Poor | Good | Yes |
| Comp. Ex. 26 | B22 | 55 | 9 | 16 | 1120 | 50 | 74 | 38* | Poor | Good | Yes |
| Comp. Ex. 27 | B23 | 45 | 8 | 16 | 1150 | 40 | 70 | 33* | Poor | Good | Yes |
| Comp. Ex. 28 | B24 | 40 | 5 | 16 | 1100 | 55 | 75 | 23* | Poor | Good | Yes |

Note that, when using austenitic stainless steel sheet to produce an outer shell of a turbocharger or other exhaust components, the other conditions in the manufacturing process may be suitably selected. For example, the slab thickness, hot rolled sheet thickness, etc. may be suitably designed. In the cold rolling, the roll roughness, roll diameter, rolling oil, number of rolling passes, rolling speed, rolling temperature, etc. may be suitably selected. Process annealing may be inserted in the middle of cold rolling as well. The annealing may be batch annealing or continuous annealing. Further, it is possible to perform or omit neutral salt electrolysis or salt bath immersion as pretreatment at the time of pickling. The pickling step may comprise treatment using sulfuric acid or hydrochloric acid in addition to nitric acid and nitric acid electrolysis pickling. The cold rolled sheet may be adjusted in shape and quality by temper rolling and a tension leveler etc. after annealing and pickling. Furthermore, it is also possible to coat the finished sheet with a lubricant to further improve the press formability. The type of the lubricating film may be suitably selected. In addition, after working the components, it is also possible to nitride them or carburize them or otherwise specially treat their surfaces to further improve the heat resistance.

INDUSTRIAL APPLICABILITY

According to the present invention, it is possible to provide austenitic stainless steel sheet having excellent characteristics for exhaust components where workability is demanded in addition to heat resistance. By using the material to which the present invention is applied for use for turbochargers of automobiles in particular, a great reduction in weight compared with conventional castings can be achieved and progress can be made in meeting exhaust gas controls, reducing weight, and improving fuel efficiency. Further, elimination of cutting and grinding of components and elimination of surface treatment also become possible thereby greatly contributing to lower costs. Note that, the present invention can also be applied to any of the components used for turbochargers, specifically, the housings forming the outer shells of turbocharger and the precision components inside nozzle vane type turbochargers (for example, what are referred to as the back plate, oil deflector, compressor wheel, nozzle mount, nozzle plate, nozzle vane, drive ring, and drive lever). Furthermore, the invention is not limited to automobiles and motorcycles. It may also be applied to the exhaust components used in various types of boilers, fuel cell systems, and other high temperature environments. The present invention is extremely advantageous in industry.

The invention claimed is:

1. Austenitic stainless steel sheet for an exhaust component comprising, by mass %, C: 0.005 to 0.2%, Si: 0.1 to 4%, Mn: 0.1 to 5%, Ni: 2 to 25%, Cr: 15 to 30%, N: 0.01 to less than 0.4%, Al: 0.001 to 1%, Cu: 0.05 to 4%, Mo: 0.02 to 3%, V: 0.02 to 1%, P: 0.05% or less, and S: 0.01% or less, comprising a balance of Fe and unavoidable impurities, and having an annealing twin frequency of 40% or more.

2. The austenitic stainless steel sheet for an exhaust component according to claim 1 wherein said steel sheet further comprises, by mass %, N: over 0.04% to less than 0.4% and/or Si: over 1.0% to less than 3.5%.

3. The austenitic stainless steel sheet for an exhaust component according to claim 1 wherein said steel sheet further comprises, by mass %, N: over 0.15% to less than 0.4%.

4. The austenitic stainless steel sheet for an exhaust component according to claim 1 wherein said steel sheet further comprises, by mass %, one or more of Ti: 0.005 to 0.3%, Nb: 0.005 to 0.3%, B: 0.0002 to 0.005%, Ca: 0.0005 to 0.01%, W: 0.1 to 3.0%, Zr: 0.05 to 0.30%, Sn: 0.01 to 0.50%, Co: 0.03 to 0.30%, Mg: 0.0002 to 0.010%, Sb: 0.005 to 0.3%, REM: 0.002 to 0.2%, Ga: 0.0002 to 0.3%, and Ta: 0.01 to 1.0%.

5. The austenitic stainless steel sheet for an exhaust component according to claim 1 wherein said steel sheet further comprises, by mass %, Ti: over 0.03% to 0.3% and/or Nb: 0.005 to 0.05%.

6. The austenitic stainless steel sheet for an exhaust component according to claim 1 wherein said steel sheet has a high temperature yield strength at 900° C. of 70 MPa or more.

7. A method for producing austenitic stainless steel sheet for an exhaust component according to claim 1, said method for producing stainless steel sheet comprising steps of cold rolling and annealing the cold rolled sheet, wherein in the step of cold rolling, a reduction is in a range of 60% or less and wherein in the step of annealing the cold rolled sheet, a heating rate at a temperature which is less than 900° C. is less than 10° C./sec, a heating rate at a temperature of 900° C. and more is 10° C./sec or more, and a highest temperature is in a range of from 1000 to 1200° C.

8. A housing forming an outer shell of a turbocharger or a precision component at the inside of a nozzle vane turbocharger, comprising:

the austenitic stainless steel sheet according to claim 1.

9. A back plate, oil deflector, compressor wheel, nozzle mount, nozzle plate, nozzle vane, drive ring, and drive lever inside of a nozzle vane turbocharger, comprising:

the austenitic stainless steel sheet according to claim 1.

10. An exhaust component, comprising:

the austenitic stainless steel sheet according to claim 1.

11. An exhaust component wherein at least one of a housing forming an outer shell of a turbocharger and a precision part inside of a nozzle vane turbocharger comprises the austenitic stainless steel sheet according to claim 1.

12. A housing forming an outer shell of a turbocharger comprising the austenitic stainless steel sheet according to claim 1.

13. A nozzle vane turbocharger wherein at least one of a back plate, oil deflector, compressor wheel, nozzle mount, nozzle plate, nozzle vane, drive ring, and drive lever comprises the austenitic stainless steel sheet according to claim 1.

14. The austenitic stainless steel sheet for an exhaust component according to claim 2 wherein said steel sheet further comprises, by mass %, N: over 0.15% to less than 0.4%.

15. The austenitic stainless steel sheet for an exhaust component according to claim 2 wherein said steel sheet further comprises, by mass %, one or more of Ti: 0.005 to 0.3%, Nb: 0.005 to 0.3%, B: 0.0002 to 0.005%, Ca: 0.0005 to 0.01%, W: 0.1 to 3.0%, Zr: 0.05 to 0.30%, Sn: 0.01 to 0.50%, Co: 0.03 to 0.30%, Mg: 0.0002 to 0.010%, Sb: 0.005 to 0.3%, REM: 0.002 to 0.2%, Ga: 0.0002 to 0.3%, and Ta: 0.01 to 1.0%.

16. The austenitic stainless steel sheet for an exhaust component according to claim 3 wherein said steel sheet further comprises, by mass %, one or more of Ti: 0.005 to 0.3%, Nb: 0.005 to 0.3%, B: 0.0002 to 0.005%, Ca: 0.0005 to 0.01%, W: 0.1 to 3.0%, Zr: 0.05 to 0.30%, Sn: 0.01 to 0.50%, Co: 0.03 to 0.30%, Mg: 0.0002 to 0.010%, Sb: 0.005 to 0.3%, REM: 0.002 to 0.2%, Ga: 0.0002 to 0.3%, and Ta: 0.01 to 1.0%.

17. The austenitic stainless steel sheet for an exhaust component according to claim 2 wherein said steel sheet further comprises, by mass %, Ti: over 0.03% to 0.3% and/or Nb: 0.005 to 0.05%.

18. The austenitic stainless steel sheet for an exhaust component according to claim 3 wherein said steel sheet further comprises, by mass %, Ti: over 0.03% to 0.3% and/or Nb: 0.005 to 0.05%.

19. The austenitic stainless steel sheet for an exhaust component according to claim 4 wherein said steel sheet further comprises, by mass %, Ti: over 0.03% to 0.3% and/or Nb: 0.005 to 0.05%.

20. The austenitic stainless steel sheet for an exhaust component according to claim 2 wherein said steel sheet has a high temperature yield strength at 900° C. of 70 MPa or more.

21. The austenitic stainless steel sheet for an exhaust component according to claim 1 wherein said steel sheet further comprises, by mass %, Si: over 1.0% to 4%.

* * * * *